US005449270A

United States Patent [19]

Levi et al.

[11] Patent Number: 5,449,270

[45] Date of Patent: Sep. 12, 1995

[54] TANGENTIAL FLOW PUMPING CHANNEL FOR TURBOMOLECULAR PUMPS

[75] Inventors: Giampaolo Levi, Turin, Italy; John C. Helmer, Menlo Park, Calif.

[73] Assignee: Varian Associates, Inc., Palo Alto, Calif.

[21] Appl. No.: 265,542

[22] Filed: Jun. 24, 1994

[51] Int. Cl.[6] ..... F04D 19/04

[52] U.S. Cl. ..... 415/90; 415/55.3

[58] Field of Search ..... 415/90, 55.2, 55.3, 415/55.4

[56] References Cited

U.S. PATENT DOCUMENTS

| | | | |
|---|---|---|---|
| 5,020,969 | 6/1991 | Mase et al. | 415/55.3 |
| 5,238,362 | 8/1993 | Casaro et al. | 415/90 |
| 5,374,160 | 12/1994 | Hablanian | 415/90 |
| 5,387,079 | 2/1995 | Levi | 415/90 |

*Primary Examiner*—Edward K. Look

*Assistant Examiner*—Michael S. Lee

*Attorney, Agent, or Firm*—Bella Fishman; David J. Power

[57] ABSTRACT

The present invention relates to turbomolecular pumps comprising one or more tangential flow pumping stages in addition to axial flow pumping stages, so as to raise the pump exhaust pressure up to the atmospheric pressure, wherein at least one tangential flow pumping stage having a tangential flow pumping channel of improved design. The channel is located between the lateral surface of the rotor disk and the annular inner wall of stator and comprises an upper closure plate provided with suction port and a lower closure plate provided with diskharge port wherein these ports operably coupled to the tangential flow pumping channel. The cross-section area of the channel is enlarged from its periphery portion defined by the lateral surface of the rotor disk to a central portion defined by the upper and lower closure plates.

5 Claims, 2 Drawing Sheets

TANGENTIAL FLOW PUMPING CHANNEL FOR TURBOMOLECULAR PUMPS

FIELD OF THE INVENTION

The present invention relates to a tangential flow pumping channel of improved designed for turbomolecular pumps. In particular it relates to a tangential flow pumping channel utilizing one or more tangential flow pumping stages in conjunction with axial flow pumping stages.

BACKGROUND OF THE INVENTION

Tangential flow pumping stages have previously been incorporated in turbomolecular pumps, an example of which is disclosed in European Patent Application Publication No. EP 0,445,855 assigned to the assignee of the present application.

The cited '855 publication pertains to a turbomolecular pump which, in addition to conventional axial flow pumping stages, utilizes one or more tangential flow pumping stages, wherein the stator ring surrounding the rotor disk and the rotor disk surfaces are substantially parallel, thereby defining a pumping channel therebetween of substantially rectangular cross-section and uniform width.

Research carried out testing the operational characteristics of the tangential channels of the aforementioned pumps has shown that the enlarged modifications of the rectangular cross-section of the pumping channel lead to the impressive restricts in terms of pumping speed compression ratio.

Accordingly, one of the advantages of the present invention is a tangential flow pumping channel of improved design, as part of one or more tangential flow pumping stages in an axial flow turbomolecular pump, which is designed to substantially improve the above-identified operational characteristics of said turbomolecular pump.

A further advantage of the present invention is a pumping channel of improved design as an element of a turbomolecular pump which can be easily manufactured at a low cost.

SUMMARY OF THE INVENTION

These and other advantages of the present invention are achieved by means of a turbomolecular pump comprising a tangential flow pumping stage and axial flow pumping stage wherein the tangential flow pumping stage having a flow channel located between an annular grooved inner wall of a stator and a lateral portion of a rotor disk. The lateral surface of the rotor disk may be grooved. The flow channel has a central portion defined by an upper and lower closure plates with a suction and discharge ports respectively, and a periphery portion defined by the lateral surface of the rotor disk and the annular grooved inner wall of the stator the suction and discharge ports operably coupled to the tangential flow channel. Wherein a cross-sectional area of the channel is enlarged from the periphery to the central portion. The tangential flow pump further comprising a baffle. The upper closure plates and a first plane surface of the rotor disk facing this upper plate defining a first region of close tolerance between discharge port and suction port while the lower closure plate and a second plane surface of the rotor disk opposed to the first one and facing the lower closure plate defining a second region of close tolerance between the discharge port and the rotor disk. The baffle is protruded from the plates, extending into the groove of the rotor disk and forming a third region of close tolerance therewith.

BRIEF DESCRIPTION OF THE DRAWINGS

The invention will now be described in greater detail herein after relative to non-limitative embodiments, with reference to the accompanying drawings, in which.

DETAILED DESCRIPTION OF THE INVENTION

Figure 1:
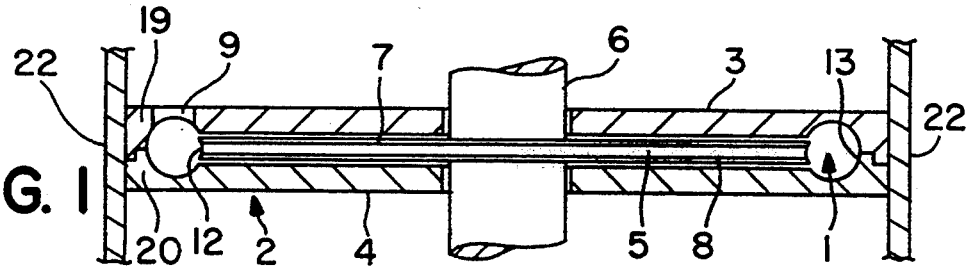
FIG. 1 is a schematic view in axial section showing the channel of the present invention in a first embodiment.
Figure 5:
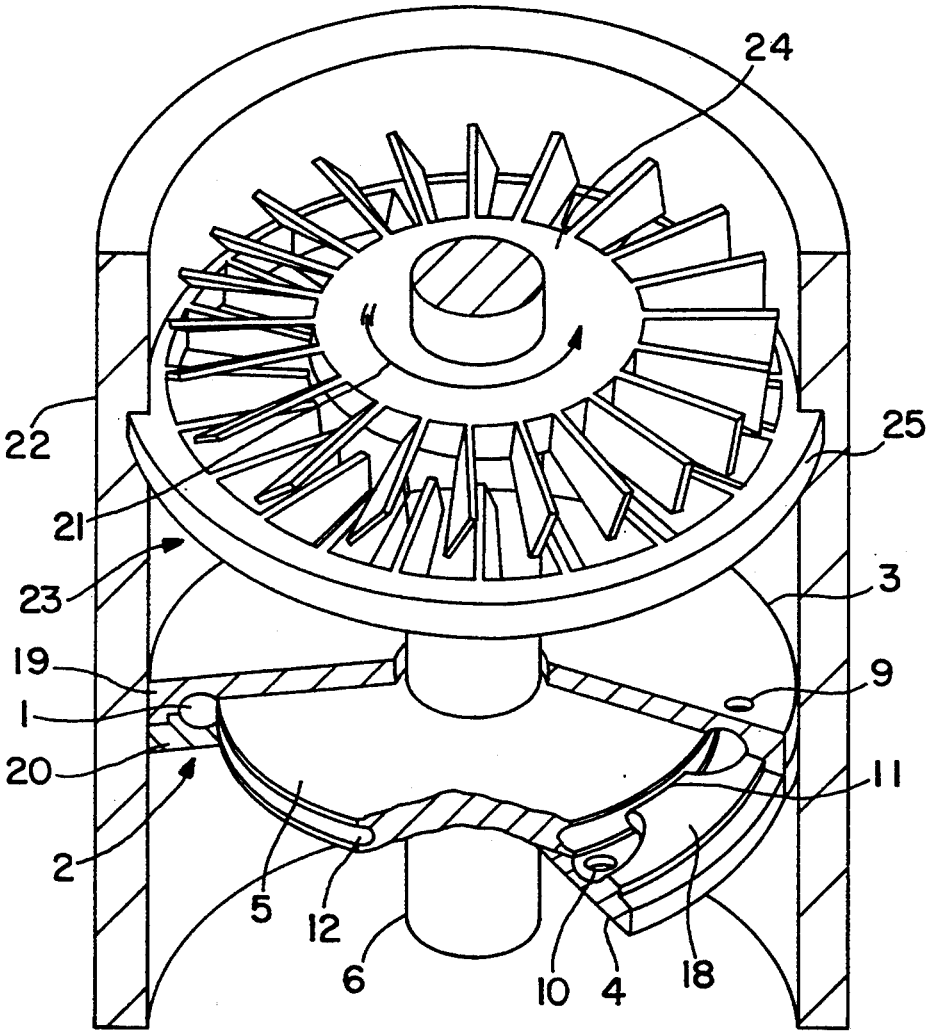
FIG. 5 is a partially broken perspective view of a part of a turbomolecular pump housing having a tangential pumping stage and a pumping channel according to the embodiment of FIG. 1.
Figure 6:
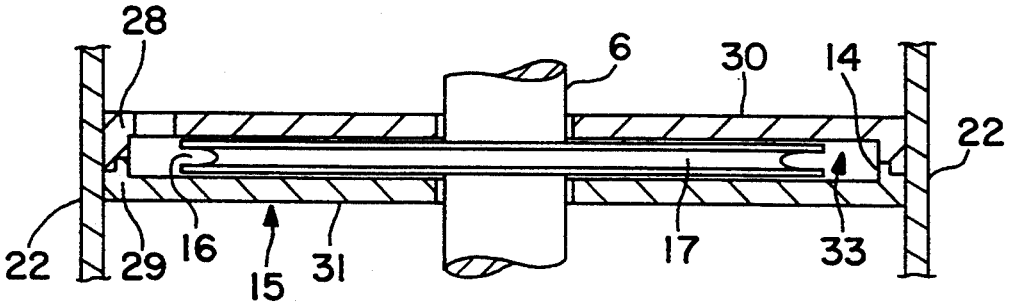
FIG. 6 is a schematic view of an axial section showing the channel of the present invention in a fifth embodiment, this figure shows a rotor with a U-shaped groove.

A first embodiment of the present invention is depicted in FIG. 1 and FIG. 5, wherein a pumping channel 1 of circular cross-section is formed in a tangential pumping stage within the walls of a stator 2, consisting of a first upper closure plate 3 and a second lower closure plate 4, and having a rotor disk 5 secured to a shaft 6 and positioned between said upper closure plate 3 and lower closure plate 4. The area between the upper and lower closure plates and the first upper plane and second lower plane surfaces of rotor disk 5 thereby defines a first and second region 7 and 8 respectively, of close tolerance between said closure plates and the rotor disk. Upper closure plate 3 and lower closure plate 4 are joined together by suitable means known to those skilled in the art, an example of which is shown in the figures which depict the coupling of downwardly extending edge 19 of upper closure plate 3 with the upwardly extending edge 20 of lower closure plate 4. The upper and lower closure plates are further provided with a suction port 9 and a discharge port 10 respectively, both in fluid communication with channel 1.

The interior wall surface 13, formed by the junction of said plate edges 19 and 20, has a substantially semicircular internal perimeter thereby forming a circular passageway when cooperating with a substantially semicircular groove 12 provided in the peripheral edge of rotor disk 5. Channel 1 is partially closed by baffle 18 which extends from plate edges 19 and 20 between discharge port 10 mid suction port 9 counterclockwise, according to the direction of rotation of shaft 6, as indicated by arrow 21, wherein baffle 18 protrudes towards rotor disk 5, thus penetrating into groove 12 and forming a third region of close tolerance 11 therewith.

In FIG. 5 a pump housing 22 is shown comprising, in addition to a tangential flow pumping stage having a pumping channel according to the present invention, an axial flow pumping stage 23 is provided, equipped with a vane rotor 24 and a vane stator 25.

Figure 2:
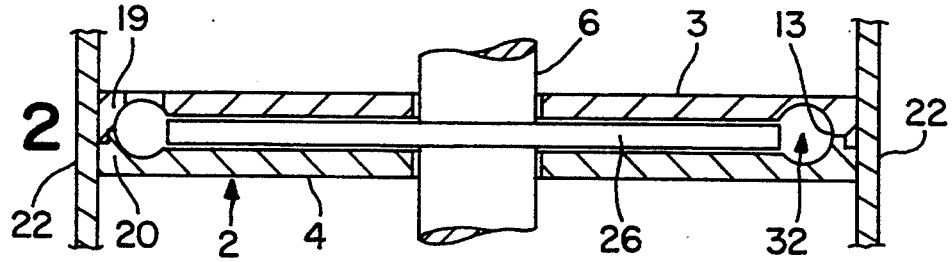
FIG. 2 is a schematic view in axial section showing the channel of the present invention in a second embodiment.

Referring now to FIG. 2 there is shown a first modified embodiment of the present invention. The essential difference between this modified embodiment and the embodiment depicted in FIG. 1 is that a rotor 26, having a plane lateral surface for a peripheral edge, is provided instead of a rotor with a semicircular groove. In this modified embodiment, the lateral surface thereby defines channel 32 of substantially semicircular cross-section rather than a channel of substantially circular cross-section as was provided in the previous embodiment. In this embodiment identical components have been given the same reference numerals as those shown in FIG. 1.

The advantages of the present invention's use of a pumping channel having a circular or semicircular cross-sectional area is particularly evident in molecular flow. Under molecular flow conditions we can assume for the pumping speed S the following relation:

$$S \approx A \cdot V_S$$

where A is the cross-sectional area of the pumping channel; and where $V_S$ is the velocity averaged along the stator and rotor walls, and shown to be adversely proportional to the pumping channel perimeter, according to the following relation:

$$V_s = \frac{\oint v \cdot dL}{\oint dL}$$

where L is the pumping channel perimeter and V is the velocity of a perimeter element dL in the axial direction.

It is well known from common Euclidean geometry that for two figures having the same area A but different shape, the perimeter is at a minimum when the shape is circular. Therefore it can be easily understood from the above geometric relationship that $V_S$ and S are maximized by choosing a circular shape for the stationary part of the perimeter L, and $V_S$ is further increased by grooving the edge of the rotor as for example with a semicircular groove.

A further consideration in the design of turbomolecular pumps regards the relative position of the moving surface of the rotor i.e., the peripheral wall with respect to the stator wall. It is well known that the more the rotor penetrates the pumping channel, the more the value $V_S$ is increased, while conversely the less the rotor penetrates the pumping channel the more the channel cross-sectional area A increases. Based on these operational constraints it has been found that the best performances for the pumping of the present invention are achieved by utilizing a circular channel section obtained by means of a semicircular stator surface cooperating together with an opposing grooved rotor surface as disclosed above.

Figure 3:
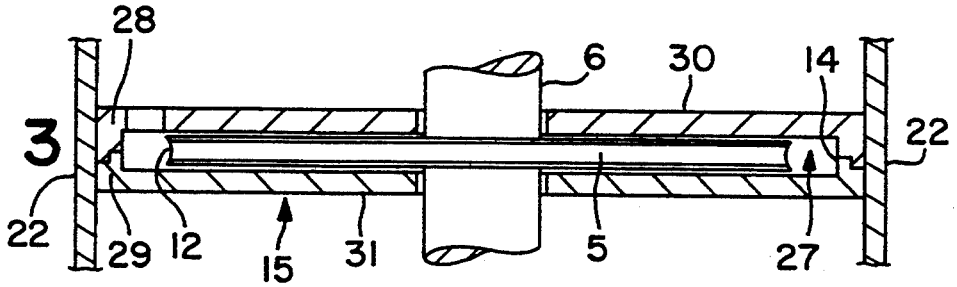
FIG. 3 is a schematic view in axial section showing the channel of the present invention in a third embodiment.
Figure 4:
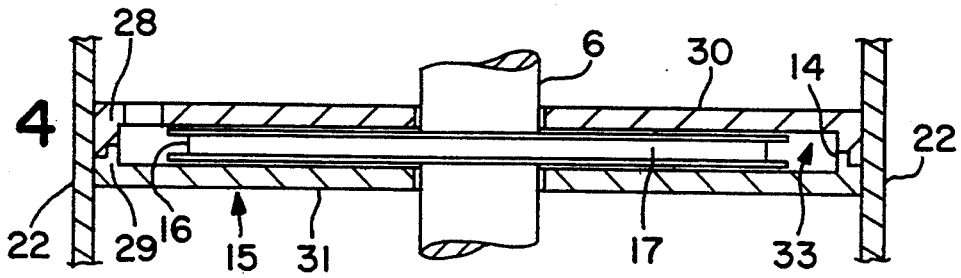
FIG. 4 is a schematic view in axial section showing the channel of the present invention in a fourth embodiment.

Referring now to FIGS. 3 and 4 embodiments are disclosed which are less expensive alternative solutions utilizing a partially optimized channel. In FIG. 3 there is shown a channel 27 of substantially semicircular cross-section obtained by means of a semicircular groove 12 in the peripheral wall of rotor 5. The downwardly extending edge 28 of upper closure plate 30 and the upwardly extending edge 29 of lower closure plate 31 in stator 15 provide for a substantially rectangular shape for internal surface 14 of channel 27, thereby forming a semicircular pumping channel having a larger moving surface. In FIG. 4 there is shown still another embodiment of the present invention wherein rotor disk 17 is provided with a substantially rectangular groove 16 in its peripheral edge, thereby defining a channel 33 of substantially semicircular cross-section. In this embodiment identical components have been given the same reference numerals as those provided in FIG. 3.

While the present invention has been described in conjunction with a few specific embodiments, it is evident to those skilled in the art that many alternatives, modifications and variations will be apparent in light of the foregoing description. Accordingly, the invention is intended to embrace all such alternatives, modifications and variations as fall within the spirit and scope of the appended claims.

What is claimed is:

1. A turbomolecular pump having a tangential flow pumping stage and axial flow pumping stage, said tangential flow pumping stage comprising:

a rotor disk and a stator. said stator having an annular grooved inner wall receiving a lateral portion of said rotor disk;

said lateral portion of said rotor disk and said annular grooved inner wall of said stator defining a flow channel;

an upper closure plate having a suction port, said suction port communicating with said channel;

a lower closure plate having a discharge port, said discharge port communicating with said channel;

said upper closure plate and a first plane surface of said rotor disk facing said upper closure plate defining a first region of tolerance between said rotor disk and said suction port;

said lower closure plate and a second plane surface opposed to said first plane of said rotor disk facing said lower closure plate defining a second region of tolerance between said discharge port and said rotor disk;

said channel having a central portion defined by said upper and said lower closure plates and a periphery portion defined by said lateral surface of said rotor disk and said annular grooved inner wall, wherein said channel has a cross-section area enlarged from said periphery portion to said central portion;

a baffle, a baffle being protruded from said plates, extending into said groove in said rotor disk and forming a third region of tolerance therewith.

2. The turbomolecular pump of claim 1 wherein said groove of said rotor disk is semicircular.

3. A turbomolecular pump having a tangential flow pumping stage and axial flow pumping stage, said tangential flow pumping stage comprising:

a rotor disk and a stator, said stator having a rectangular grooved inner wall receiving a lateral portion of said rotor disk;

said lateral portion of said rotor disk and said rectangular grooved inner wall of said stator defining a flow channel;

an upper closure plate having a suction port, said suction port communicating with said channel;

a lower closure plate having a discharge port, said discharge port communicating with said channel;

said upper closure plate and a first plane surface of said rotor disk facing said upper closure plate defining a first region of tolerance between said rotor disk port and said suction port;

a baffle, a baffle being protruded from said plates, extending into said groove in said rotor disk and forming a third region of tolerance therewith:

said lower closure plate and a second plane surface of said rotor disk facing said lower closure plate defining a second region of tolerance between said discharge port and said rotor disk;

said channel having a central portion defined by said upper and said lower closure plates and a periphery portion defined by said lateral surface of said rotor disk and said rectangular grooved inner wall, wherein said channel has a cross-section area enlarged from said periphery portion to said central portion.

4. The turbomolecular pump of claim 3 wherein said groove of said rotor disk is semicircular.

5. The turbomolecular pump of claim 3 wherein said groove of said rotor disk is substantially U-shaped.

* * * * *